United States Patent [19]

Litton, Sr. et al.

[11] Patent Number: 4,953,316

[45] Date of Patent: Sep. 4, 1990

[54] CHOKE STORAGE DEVICE FOR SHOTGUNS

[76] Inventors: Ernest C. Litton, Sr., 5410 South 12th Ave., Tucson, Ariz. 85706; Glen F. Thompson, 2701 W. Jennie La., Tucson, Ariz. 85713

[21] Appl. No.: 412,193

[22] Filed: Sep. 25, 1989

[51] Int. Cl.[5] ..... F41A 35/00

[52] U.S. Cl. ..... 42/90

[58] Field of Search ..... 42/49.01, 49.02, 79, 42/90, 95, 97, 106

[56] References Cited

U.S. PATENT DOCUMENTS

| | | | |
|---|---|---|---|
| 1,089,000 | 3/1914 | Kramer | 42/49.01 |
| 1,702,221 | 2/1929 | Parsons | 42/49.02 |
| 2,937,465 | 5/1960 | Denaux, Sr. | 42/79 |
| 3,123,929 | 3/1964 | Pachmayr et al. | 42/79 |
| 3,371,440 | 3/1968 | Cassell | 42/49.02 |
| 3,381,403 | 5/1968 | Murdoch | 42/106 |
| 3,619,925 | 11/1971 | Martin et al. | 42/97 |
| 4,602,449 | 7/1986 | Holmes | 42/49.02 |
| 4,736,540 | 4/1988 | Holmes | 42/90 |
| 4,837,962 | 6/1989 | Longerot | 42/90 |

*Primary Examiner*—Stephen C. Bentley

*Attorney, Agent, or Firm*—LaValle D. Ptak

[57] ABSTRACT

A choke holder device is provided for attachment to the end of a magazine on a shotgun. The cap which normally closes the end of the shotgun shell magazine is removed, and a first hollow choke storage member is threaded onto or otherwise secured to the magazine to close the magazine. The choke storage member then extends outwardly from the magazine. Additional hollow cylindrical choke storage members are provided for releasable attachement to one another and to the end of the first choke storage member. Each storge member is selected to have a length sufficient to store a removable shotgun choke therein. The number of storage members attached to the magazine and to one another in an end-to-end relationship is selected to correspond with the number of different chokes to be stored. The final storage member is closed on the end with a removable closure cap.

10 Claims, 1 Drawing Sheet

CHOKE STORAGE DEVICE FOR SHOTGUNS

BACKGROUND

Modern shotguns frequently have the end of the barrel threaded to accommodate different screw-in chokes. Typically, the chokes are externally threaded at one end to permit them to be threaded into the internally threaded end of the muzzle of the shotgun. The various chokes operate to vary or control the pattern of the shot discharged from the muzzle of the shotgun.

Frequently, shotgun owners substitute different chokes on the muzzle of the shotgun to vary the shot pattern in accordance with the result desired and for different shooting conditions. As a consequence, unused chokes must be stored somewhere. Usually, they simply are placed in a pocket of a hunting jacket when they are not in use. If several chokes are so stored, they bang together in the pocket and are subject to damage, particularly to the relatively fine threads which are formed on the exterior surface for engagement with the internally threaded muzzle of the shotgun.

Shotguns also may be provided with plugs of varying lengths to limit the number of shells which can be carried in the magazine of the gun at any one time. For example, the laws of some states prohibit the insertion of more than two shells into the magazine of a shotgun, and such a plug fills the space which would otherwise be occupied by shells.

The Patent to Holmes #4,602,449 discloses a plug for a shotgun magazine which, in turn, is hollow and threaded for receiving the externally threaded portion of a conventional screw-in type of choke. This plug then serves a dual purpose of storing an unused choke while, at the same time, performing its function of filling space in the magazine. It is necessary, however, for the plug/choke holder combination of the device of Holmes to work, that the internal diameter of the magazine of the shotgun is capable of accommodating the plug and its internally carried choke. The entire device fits inside the magazine in the position normally occupied by either shells or a magazine plug.

In contrast to the plug device of the Holmes Patent, the Patent to Kramer #1,089,000 discloses an extension which is threaded onto the end of the shell magazine to permit an expansion of the shell capacity. The extension is in the form of an elongated tube threadedly engaged with the end of the magazine and forming a continuous cylindrical passage with the interior of the magazine.

The Patent to Martin et al. #3,619,925 discloses an adapter for the end of the shell magazine of a shotgun to permit one or more housings to be screwed onto the end of the magazine. Each of the housings is filled with weights to permit changes in the balance of the shotgun for tailoring the "feel" of the shotgun to an individual sportsman.

It is desirable to provide a simple, improved carrier mounted on a shotgun for holding additional chokes when the chokes are not in use.

SUMMARY OF THE INVENTION

It is an object of this invention to provide an improvement for shotguns.

It is an additional object of this invention to provide an improved choke holder device for shotguns.

It is another object of this invention to provide an improved choke holder device for attachment to the end of the cartridge magazine of a shotgun.

It is a further object of this invention to provide a choke holder device for a shotgun having a magazine in the form of a plurality of choke holding modules which are interconnected with one another and with the magazine opening for storing a desired number of shotgun chokes when the chokes are not in use.

In accordance with the preferred embodiment of this invention, a choke holder device for a shotgun comprises at least first and second storage members. The first storage member is substantially closed at one end, and this end is secured to the end of the shotgun magazine. Both of the choke storage members have a hollow cylindrical interior and the second member is removably attached to the first member to form an elongated, hollow cylindrical storage container. Each of the members is selected to have a length capable of accommodating a shotgun choke. The end of the second member is selectively closed with a releasable cap, and spare chokes are stored in the members until use of such chokes is desired.

DETAILED DESCRIPTION

Reference now should be made to the drawings in which the same reference numbers are used in all four figures to designate the same components.

Figure 1:
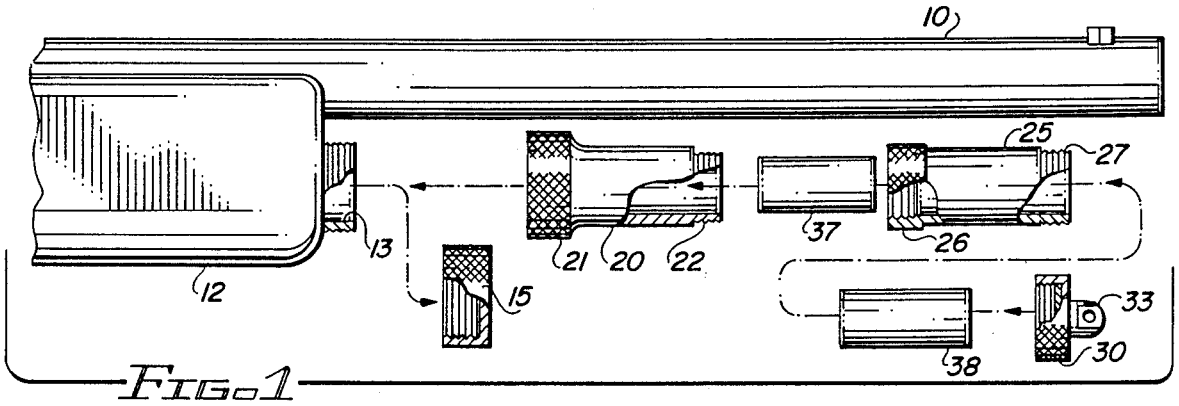
FIG. 1 is an exploded view of a preferred embodiment of the invention.

FIG. 1 illustrates a portion of a shotgun comprising a barrel 10 and a shell magazine, terminating in a threaded opening 13 which is selectively closed by a cap 15 to permit the insertion of shotgun shells, springs, and plugs into the magazine 12.

As illustrated in the various figures of the drawing, the cap 15 may be removed and replaced with a first cylindrical choke storage member 20, the left end of which is flared outwardly in a knurled portion 21. This end is internally threaded to engage the threads on the end 13 of the magazine. The manner in which the choke storage member 20 is secured to the end 13 as shown most clearly in FIG. 3. The left-hand end of the choke storage member 20 has a shoulder 23 around it with a relatively small diameter hole through it. A cushion disk 24, made of suitable material such as cork, is placed in the left-hand end of the member 20 to close the opening, as shown most clearly in FIGS. 3 and 4. The shoulder 23 also extends sufficiently into the opening in the end of the portion 13 of the magazine, so that shotgun shells, plugs and the like which are placed in the magazine 13 are held in place by the shoulder 23 in the same manner as they normally are held in place by the cap 15.

The right-hand end of the hollow choke storage member 20 is open and is externally threaded at 22. The length of the internal cavity of the member 20 is selected to be sufficient to accommodate a standard shotgun choke 37 (FIG. 1). If only a single choke is to be stored, a cap 30 then may be threaded over the threads 22 to close the storage member 20.

Figure 2:
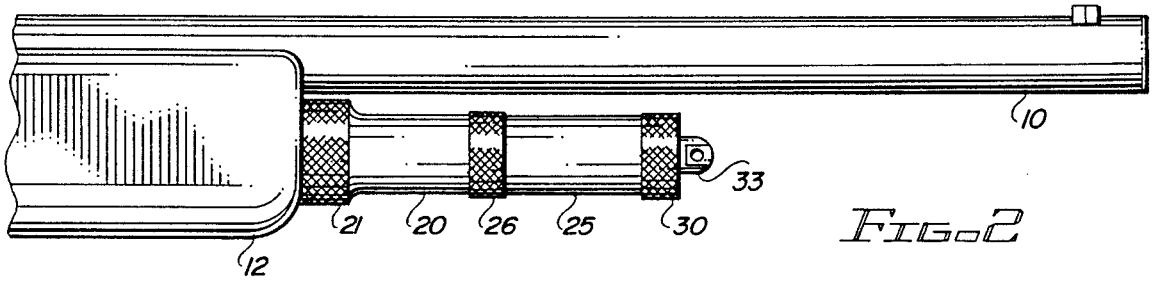
FIG. 2 is an assembled view of the embodiment of FIG. 1.
Figure 3:
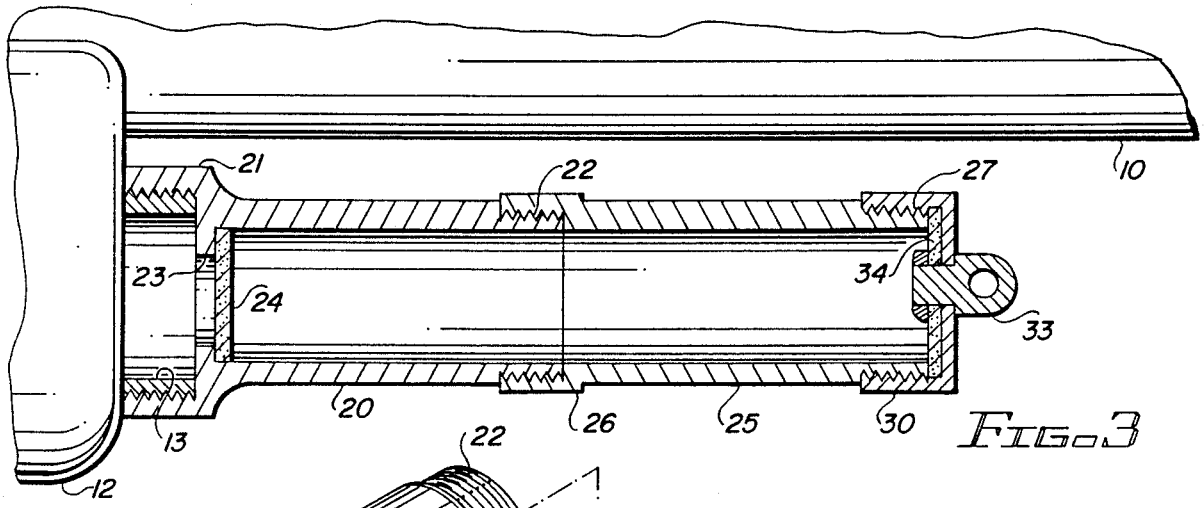
FIG. 3 is a cross-sectional view of the embodiment shown in FIGS. 1 and 2.
Figure 4:
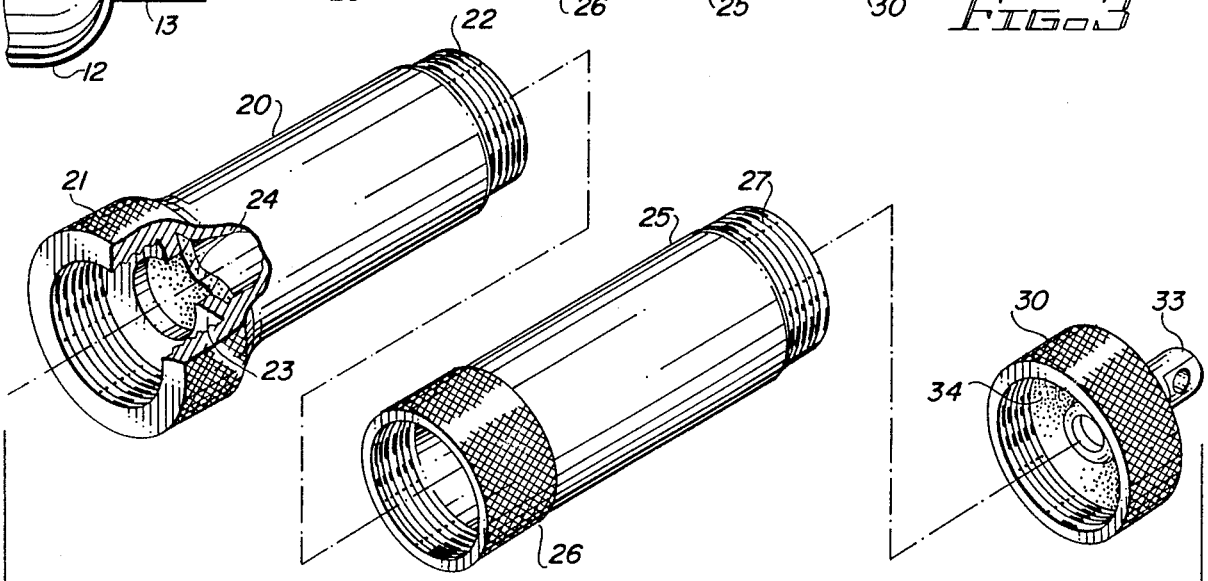
FIG. 4 is an exploded, perspective view of the preferred embodiment of the invention.

Frequently, however, more than one choke is to be stored, such as the second choke 38 shown in FIG. 1. To accommodate the storage of such an additional choke, a second hollow cylindrical choke storage extender 25 is provided. The extender 25 has internal threads on its left-hand end for engaging the threads 22 of the member 20. This end of the extender 25 also is knurled on the outside (at 26) over the threads to facilitate its placement on and removal from the right-hand end of the storage member 20. The right-hand end of the extender 25 is externally threaded at 27, in the same manner as the threads 22 on the storage member 20. Consequently, the cap 30 may be removably secured by threadedly engaging the threads 27 on the end of the extender 25, when the extender 25 is threaded in place over the right-hand end of the storage member 20, as shown in FIGS. 2 and 3.

If additional extenders 25 are desired, they may be interconnected with one another in the same manner that the extender 25, shown in the various figures of the drawing, is threadedly attached to the right-hand end of the choke storage member 20. The number of extenders 25 which are used depends upon the number of chokes, such as the chokes 37 and 38, which are to be stored at any given time. Obviously, a practical limit to the number of extenders 25 which may be utilized essentially is determined by the length of the barrel 10.

The cap 30 is shown as having a swivel 33 on it to permit the cap 30 to be attached by means of a cord or the like to the shotgun or magazine, so that the cap does not become lost when it is removed. The inside of the cap 30 is lined with a resilient cushion 34, which may be made of cork or other suitable material.

The members 25 and the storage member 20 each have an internal length sufficient to store or accommodate a choke 37 or 38 placed on them. Thus, the stored chokes abut one another end-to-end, but the smooth interior cylindrical surfaces of the member 20 and extender 25 prevent damage from occurring to the threads of the chokes. When use of a choke 37 or 38 is desired, the cap 30 is removed; and the chokes are poured out of the cylindrical container which is formed by the members 20 and 25. The sportsman then selects the proper choke, and installs it into the barrel of the shotgun 10 in a conventional manner. By making the storage member 20, the extender 25, and the cap 30 out of anodized aluminum, the weight of the composite storage device is minimal. Consequently, it does not adversely affect the balance of the shotgun even when multiple extenders 25 are used. Any suitable material may be used for the parts 20, 25 and 30, however.

If access to the shotgun magazine 12 through the opening 13 is desired, the entire assembly may be removed by grasping the knurled portion 21 of the storage member 20 to unthread it from the opening 13 of the magazine. If chokes are stored in the assembled device, they continue to be held in place between the cap 30 and the shoulder 23 and are protected from damage. When access to the shotgun magazine no longer is required, the device is reassembled onto the opening 13 in the manner described above and chokes may be removed from and placed into the storage device formed by removing the cap 30 to provide access to the storage chamber in the composite device, constituting the member 20 and the extender 25.

The choke storage device illustrated in the drawing and described above is to be considered illustrative of the invention and not as limiting. Various changes and modifications will occur to those skilled in the art without departing from the true scope of the invention, as defined in the appended claims.

We claim:

1. A choke holder device for a shotgun having a magazine for holding shells, said magazine having an end thereof closed by a removable cap, said choke holder device including in combination:

a first hollow choke storage member having first and second ends for storing at least one choke therein, said first storage member having releasable attaching means on the first end thereof for attaching said first end thereof to the magazine of said shotgun with the removable cap thereof removed, said first storage member being substantially closed at the first end thereof to close the end of the magazine of said shotgun; and being open at the second end thereof to permit the insertion of a choke therein;

a second hollow choke storage extender member with open first and second ends for storing at least one choke therein;

interconnecting means for releasably interconnecting the first end of said second choke extender member with the second end of said first choke storage member to form a continuous passageway through said first and second members; and removable closure means for closing the second end of said second choke storage extender member.

2. The combination according to claim 1 wherein said first choke storage member and said second choke storage extender member are hollow cylindrical members.

3. The combination according to claim 2 wherein said interconnecting means comprises mating male and female threads on the respective interconnected ends of said first storage member and said second storage extender member.

4. The combination according to claim 3 wherein the second ends of said first choke storage member and said second choke storage extender member both are externally threaded; and wherein the first end of said second choke storage extender member is internally threaded to matingly engage the external threads on the second end of said first choke storage member.

5. The combination according to claim 4 wherein said interconnected first choke storage member and said second choke storage extender member provide a continuous interior cylindrical passageway having a uniform internal diameter.

6. The combination according to claim 5 wherein said removable closure means comprises a threaded closure having mating threads engaging corresponding mating threads on the second end of said second storage extender member.

7. The combination according to claim 6 wherein a plurality of open second hollow cylindrical choke storage extender members are provided for releasable interconnection with one another and with said first choke storage member.

8. The combination according to claim 3 wherein said removable closure means comprises a threaded closure having mating threads engaging corresponding mating threads on the second end of said second storage extender member.

9. The combination according to claim 2 wherein a plurality of open second hollow cylindrical choke storage extender members are provided for releasable interconnection with one another and with said first choke storage member.

10. The combination according to claim 2 wherein said interconnected first choke storage member and said second choke storage extender member provide a continuous interior cylindrical passageway having a uniform internal diameter.

* * * * *